United States Patent [19]

Zajac

[11] 4,377,262

[45] Mar. 22, 1983

[54] TWO-WAY COLLAPSIBLE MANDREL WITH WINDING COMPRESSION

[75] Inventor: Ronald E. Zajac, Golden's Bridge, N.Y.

[73] Assignee: Windings, Inc., Golden's Bridge, N.Y.

[21] Appl. No.: 242,130

[22] Filed: Mar. 9, 1981

[51] Int. Cl.[3] ..... B65H 55/02

[52] U.S. Cl. ..... 242/1; 242/163; 242/168

[58] Field of Search ..... 242/163, 168, 169, 1, 242/18 R

[56] References Cited

U.S. PATENT DOCUMENTS

| | | | |
|---|---|---|---|
| Re. 11,856 | 9/1900 | Wardwell, Jr. | 242/168 X |
| 3,565,365 | 2/1971 | Newman | 242/163 |
| 3,747,746 | 7/1973 | Newman et al. | 242/163 X |
| 3,748,817 | 7/1973 | Newman | 242/163 X |
| 3,803,796 | 4/1974 | Newman et al. | 242/163 X |

*Primary Examiner*—Stanley N. Gilreath

*Attorney, Agent, or Firm*—Watson, Cole, Grindle & Watson

[57] ABSTRACT

In a winding wound in a figure-8 configuration, such as a universal winding which is known in the textile industry, the endforms of a spindle on which the winding is wound each respectively include openings enabling the projection therethrough of collapsing members such that the ends of the winding may be compressed to a substantially flat plane with the innermost winding. The mandrel is formed in two movable sections such that the two sections collapse towards one another with application of the compression force applied to each of the endforms.

14 Claims, 2 Drawing Figures

TWO-WAY COLLAPSIBLE MANDREL WITH WINDING COMPRESSION

BACKGROUND OF THE INVENTION

1. Field of the Invention

The invention relates to both method and apparatus for compressing the ends of universal type windings, and more particularly to such method and apparatus in which the ends of the winding may be compressed on a specially adapted spindle having endforms adapted to receive the application of pressure on the ends of the windings which also results in a commensurate collapse of the mandrel upon application of the compression force.

2. Prior Art

U.S. Pat. No. 3,565,365, assigned to the Assignee of the subject application, discloses the axial compression of the ends of a uniform winding subsequent to the removal of the spindle upon which the winding is wound. The compression is oriented such that the radial opening formed in the side of the winding from the exterior of the winding to the axial opening in the interior of the winding is positioned in one of the ends of an oval-shaped package.

U.S. Pat. No. 3,748,817, also assigned to the same Assignee as the subject application, discloses apparatus for compressing the end of a winding by placing the wound package on a package spindle having a straight-sided endform of the same inner diameter as the package spindle and the same outer diameter as the endforms on which the package was wound. A second straight-sided endform of the same size is then placed onto the packaging spindle and mechanical pressure is applied axially to both endforms so that uniform pressure is distributed over the end surfaces of the wind. The end surfaces of the winding are compressed until both ends of the wind assume a straight-line configuration and are completely in touch with the straight endforms.

SUMMARY OF THE INVENTION

Subsequent to the completion of the winding, the respective ends of the windings are simultaneously compressed by actuation of compression members which move through respective openings or apertures in the endforms of the mandrel without the necessity of removing the winding from the mandrel in order to compress the ends thereof. The mandrel itself is formed in two separate portions which are movable with respect to one another along the longitudinal axis of the winding such that the two separate mandrel portions are caused to move towards one another as the compressive force is applied to the ends of the windings. The compression of the ends of the winding is completed when the two separate portions of the mandrel are substantially completely engaged and relatively immovable with respect to one another. In this position, the respective end faces of the windings are in substantially parallel planes substantially perpendicular to the longitudinal axis of the wind.

The advantages of the winding compression in accordance with the invention are as follows: (1) the space occupied by the winding is reduced; (2) air is removed from the outer layers of the wind; (3) the inherent torque of the figure-8 wind traverse is reduced; (4) the wind is relaxed as the angle of the cross-overs in the figure-8 configuration is reduced; (5) the stability of the winding package is enhanced as the wind is enabled to be wound at relatively low tension such that the material being wound and packaged is in an inert state; (6) slippery or hard material can be wound without relying on excessive tension to hold the winding in its formation as determined by the gain settings of the winding apparatus; and (7) a highly stretchable material can be wound at very low tension while still maintaining a regular formation of the winding configuration.

The compression of the end faces of the winding also has the additional advantages of enabling the compressed winding to be packaged in a corrugated or other box-like material for shipment. Furthermore, the degree of compression of the winding can be more accurately controlled than by means of either hand compression or use of other prior art method and apparatus such as that represented by the aforementioned U.S. Pat. No. 3,748,817. The method and apparatus of the invention also enables the productivity of winding of materials to be increased and reduces operator fatigue.

BRIEF DESCRIPTION OF THE DRAWINGS

The above objects, advantages and features are readily apparent from a consideration of the following detailed description taken in conjunction with the drawings representing a preferred embodiment of the best mode of carrying out the invention, wherein.

DETAILED DESCRIPTION OF THE PREFERRED EMBODIMENT

Figure 1:
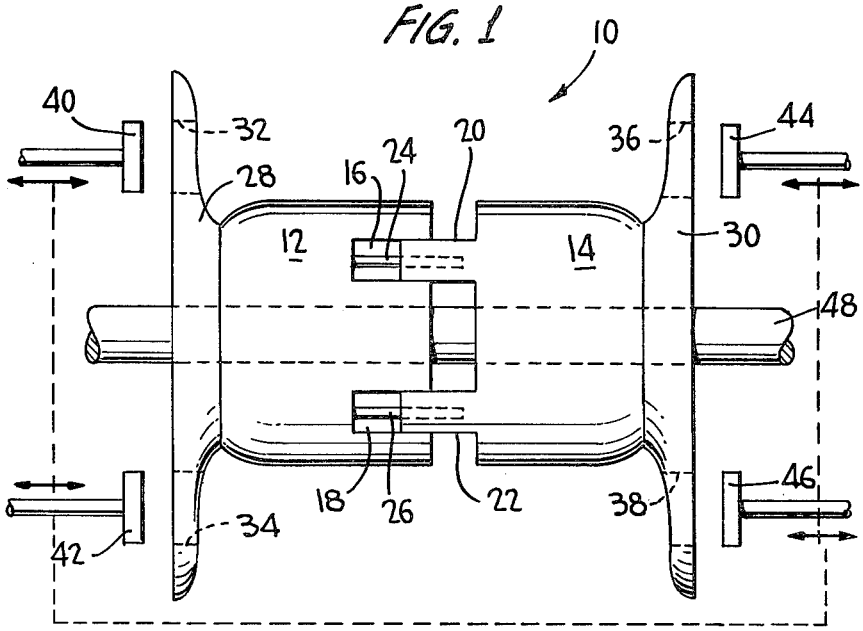
FIG. 1 represents a cross-sectional view of the preferred embodiment of the invention taken along the longitudinal axis of the mandrel upon which the material is wound.

In FIG. 1, the elements are shown in the position in which the winding is wound from a spindle or traverse mechanism known to the art (not shown) which reciprocatingly traverses across mandrel 10 along the longitudinal axis of the wind (defined by shaft 48). Mandrel 10 is formed into mandrel sections 12 and 14 so as to form a split mandrel. In that portion of mandrel section 12 confronting mandrel section 14, cut-out portions 16 and 18 are formed to receive mandrel projections 20 and 22, the latter being formed on the face of mandrel section 14 confronting mandrel section 12. Guide rods 24 and 26 respectively project from within cut-out portions 16 and 18 and extend within the guide holes respectively formed within mandrel projections 20 and 22 (as illustrated in FIG. 1) such that mandrel section 14 is movable towards and away from mandrel section 12 through the support of the projections on guide rods 24 and 26 within the openings of mandrel projections 20 and 22. Endforms 28 and 30, respectively mounted at each end of mandrel section 12 and 14, include openings 32, 34 and 36, 38. Winding compression members 40, 42 and 44, 46 are each respectively mounted to be movable through openings 32, 34 and 36, 38 in the endforms.

As shown in FIG. 1, winding compression members 40, 42 and 44, 46 are illustrated in a retracted position to enable mandrel sections 12 and 14 to rotate about shaft 48 so as to form a winding of a figure-8 configuration, or universal wind, or any other winding configuration upon the mandrel sections. Winding compression members 40, 42 and 44, 46 may be actuated by any convenient means known to the art, for example such as springs, hydraulic or pneumatic actuators. Moreover, winding compression members 40 and 42, as well as winding compression members 44 and 46, may be interlocked by any means known to the art such that each respective pair of winding compression members are moved integrally as a unitary structure (as shown by the dotted line in FIG. 1 interconnecting winding compression members 40, 42 and 44, 46). Alternatively, each of the individual winding compression members 40, 42, 44 and 46 may be actuated by independent actuation means (as illustrated by the full lines in FIG. 1). In yet another modification, all four of the compression members may be interlocked such that all of them move as a unitary assembly (as illustrated in FIG. 1 by the dotted lines interconnecting compression members 40, 42 and 44, 46 and the dotted line interconnecting winding compression members 42, 46).

Figure 2:
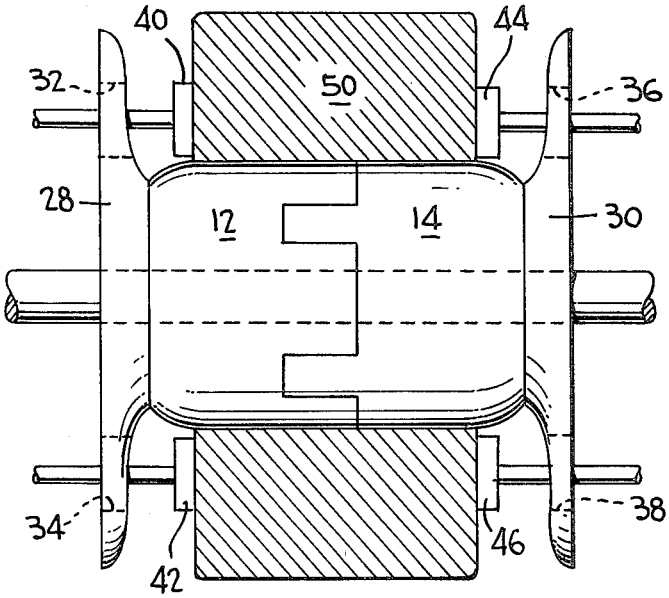
FIG. 2 shows the same view as in FIG. 1, but subsequent to the compression of the end faces of the winding by the compression members.

Upon completion of winding, as illustrated in FIG. 2, winding compression members 40, 42, 44 and 46 are preferably actuated in unison to project respectively through openings 32, 34, 36 and 38 in endforms 28 and 30 such that each opposite end face of winding 50 is compressed from an arcuate shape (as defined by the inner surfaces of endforms 28, 30) into a substantially straight line configuration. The respective end faces of the winding are then in substantially parallel planes substantially perpendicular to the longitudinal axis of the wind.

The compressive forces exerted by the pairs of winding compression members 40, 42 and 44, 46 are preferably substantially equal and opposite to one another. The compressive force on the respective opposite end faces of winding 50 must be sufficient to overcome the frictional force between the contacting surfaces of mandrel sections 12, 14 and the inner windings or coils of wind 50. During the compression of the winding end faces, mandrel sections 12 and 14 are caused to move towards one another into the interleaved relationship as illustrated in FIG. 2 by the friction existing between the inner coils of the winding on the respective mandrel surfaces of mandrel sections 12, 14. While such interleaving of mandrel sections 12 and 14 will occur with high tension winds, it may not completely occur with low tension winds as the inner windings or coils may then tend to slip along the surfaces of mandrel sections 12 and 14.

After the end faces of the winding have been compressed, winding compression members 40, 42, 44 and 46 are retracted through their respective apertures, and an endform, either endform 28 or 30, is removed and the compressed winding 50 is removed from mandrel sections 12 and 14 and packaged for shipment. Mandrel sections 12 and 14 can then be separated to the position as illustrated in FIG. 1, and with replacement of the removed endform, the mandrel 10 is then ready for a subsequent winding operation.

In the preferred embodiment of the invention as described herein, mandrel sections 12 and 14 are substantially in the form of a cylinder. However, the invention also contemplates mandrel surfaces other than cylindrical, for example of a spherical shape. Cylindrical mandrel surfaces are preferred as such shapes provide a lesser amount of friction between the inner coil or windings of the wind and the abutting mandrel surface, as compared to, for example, a spherically shaped mandrel, regardless of the tension at which the winding is wound.

Those skilled in the art will recognize that the preferred embodiment and the modifications set forth herein may be further modified. Therefore, the scope of the invention is to be determined by the claims appended hereto and any and all equivalents of the components and/or steps thereof.

What is claimed is:

1. A method of forming a compressed winding, comprising the steps of:

winding a material on a winding mandrel having an endform at each end thereof in any desired configuration; and subsequent to completion of the winding, compressing the respective opposite end faces of the winding on said winding mandrel to a substantially straight line configuration by the actuation of oppositely disposed winding compression members engaging said end faces.

2. A method as in claim 1 wherein the step of compressing the respective opposite end faces of the winding includes the step of moving compression members through openings in each of said endforms into compressive engagement with each of the opposite end face of the winding.

3. The method as in claim 2 wherein said compression members are moved in unison through said openings.

4. The method as in claim 2 wherein said compression members are moved independently through said openings into engagement with the opposite end faces of the winding.

5. The method as in claim 1 wherein said mandrel is divided into two sections movable with respect to one another, and the actuation of the oppositely disposed winding compression members causes said two mandrel sections to be moved towards one another by the frictional engagement of the winding with the two mandrel sections.

6. The method as in claim 5 wherein the actuation of the oppositely disposed winding compression members is terminated by the two sections of said mandrel being moved into abutting relationship by said frictional engagement.

7. The method as in claim 1, 2, 3, 4, 5 or 6 further comprising the steps of retracting the winding compression members, removing an endform of the winding mandrel, and removing the winding from the winding mandrel.

8. Apparatus for compressing the opposite end faces of a winding wound in any desired configuration, comprising:

a mandrel on which the winding is wound, said mandrel including endforms at the opposite ends thereof, each of said endforms including at least one opening extending through the end form; and winding compression means respectively retractable into and out of said at least one opening in each of the endforms for compressing the end faces of the winding into a substantially straight line configuration.

9. The apparatus of claim 8 wherein said mandrel is formed in two sections such that the mandrel sections are movable towards are another upon compression of the wind by said compression means.

10. Apparatus as in claim 9 wherein at least one of said two mandrel sections includes guide members formed in respective apertures within an end portion of one mandrel section confronting an end portion of the other mandrel section, and the confronting end portion of the other mandrel section includes mandrel projections engaging said guide members for movement of said mandrel projections into and out of said apertures.

11. The apparatus of claim 8, 9 or 10 wherein each of said endforms includes a pair of openings, and said winding compression means includes two respective pairs of compression members each being respectively retractable into and out of a respective one of said pair of openings.

12. Apparatus as in claim 11 wherein each respective pair of said two pairs of compression members is interlocked such that each compression member of each respective pair of compression members is moved in unison.

13. Apparatus as in claim 12 wherein said respective pairs of compression members are interlocked such that both pairs of compression members move in unison.

14. The apparatus of claim 9 wherein said mandrel sections are in abutting relationship upon completion of compression of the wind by said compression means.

* * * * *